United States Patent [19]

Mettler

[11] Patent Number: 4,458,727

[45] Date of Patent: Jul. 10, 1984

[54] DOBBY WITH LIFTING LINKAGE FOR WEAVING MACHINES

[75] Inventor: Franz Mettler, Richterswil, Switzerland

[73] Assignee: Staeubli Ltd., Horgen-Zurich, Switzerland

[21] Appl. No.: 352,930

[22] Filed: Feb. 26, 1982

[30] Foreign Application Priority Data

Mar. 2, 1981 [EP] European Pat. Off. ..... 81101483.6

[51] Int. Cl.[3] ..... D03C 13/00

[52] U.S. Cl. ..... 139/55.1; 139/66 R; 139/76

[58] Field of Search ..... 139/55.1, 66 R, 71, 139/76

[56] References Cited

U.S. PATENT DOCUMENTS 3,703,195 11/1972 Schwarz .

FOREIGN PATENT DOCUMENTS 1106704 5/1961 Fed. Rep. of Germany .
1945034 9/1969 Fed. Rep. of Germany .
1535218 10/1969 Fed. Rep. of Germany .... 139/66 R
2256140 4/1974 Fed. Rep. of Germany ..... 139/71
1201358 7/1959 France ..... 139/66 R
903,398 2/1982 U.S.S.R. ..... 139/71

*Primary Examiner*—James Kee Chi
*Attorney, Agent, or Firm*—Flynn, Thiel, Boutell & Tanis

[57] ABSTRACT

Two rotation heddle frame units pivotally engage the respective ends of a differential lever, which units move the center of the differential lever in a patternlike manner between three different positions. The movement of the center of the differential lever is transmitted, through a rocking lever, onto a plate which, in spite of the three different lever positions, moves an angle lever and thus the heddle frame into only two positions, namely, the upper and lower shed positions. The heddle frame moves without any intermediate stop between its two end positions. Since each lifting unit stands still during the operating movement of the other unit, this standstill time, together with the duration of a possible shed standstill of the weaving machine, is available for actuating the lifting unit, and a higher weaving speed is thus possible.

13 Claims, 5 Drawing Figures

DOBBY WITH LIFTING LINKAGE FOR WEAVING MACHINES

FIELD OF THE INVENTION

This invention relates to a dobby and, more particularly, to a dobby with a differential lever engaged at each end by a respective lifting unit and including a lifting linkage cooperable with the center of the differential lever and with a heddle frame, the center of the differential lever moving between three positions during operation of the dobby.

BACKGROUND OF THE INVENTION

It is common to carry out the patternlike control of an open-shed-double-lift dobby for controlling the heddle frames of a weaving machine during the shed standstill period. In the case of modern, high-speed weaving machines, however, the standstill times for this type of control are no longer sufficient, because weaving machines are already known which operate without shed standstill. In these weaving machines, the time of the shed standstill is no longer a weaving dependent function, but depends on the time needed for proper control of the dobby.

German Patent No. 1 106 704 discloses a dobby in which the center region of a differential lever can assume three operating positions. This so-called three-position dobby is typically used for weaving plush fabrics. The heddle frame must thereby cover, between two pick insertions or between two shed standstills, either the entire or half the distance from the lower to the upper shed position, or vice versa.

The classic three-position dobby is not suited for the desired goal of a dobby with an increased speed level.

Means and ways have already been developed for constructing the dobby, in connection with the weaving machine, so that a significant extension of the control time beyond the usual duration of the shed standstill is possible and can occur by means of a preselection system for the control. A different solution involving an extreme shift of the control into the times of the shed change is described in Swiss Patent No. 501 074 (corresponds to U.S. Pat. No. 3,703,195).

If, in such a dobby, the Hattersley System lifting units are replaced with the relatively new type of high-speed lifting units which have become known under the name rotation dobby, for example, those disclosed in Swiss Patent No. 372 004, Swiss Patent No. 473 253, Swiss Patent No. 517 192 (corresponds to U.S. Pat. No. 3,730,231) German Patent No. 957 648, and German OS Pat. No. 2 362 518, the disclosures of which are incorporated herein by reference, a very expensive and complicated mechanism is required, since each drive shaft of one of the four lifting units must carry out one full rotation per pick at a different time than that of the three other lifting units.

A goal of the invention is therefore a simple and economical arrangement in which the shed formation preferably occurs by means of rotation dobbies and in which a shed standstill is not needed for the control.

SUMMARY OF THE INVENTION

Inventively, this is achieved by providing a dobby of the above-mentioned type in which the lifting linkage includes a mechanism, preferably a knee joint or cam mechanism, which moves the heddle frame, for each outer operating position of the center of the differential lever, into a first position and, for the center operating position of the differential lever, into a second position.

Thus, it is possible, for example, to pivotally connect two rotation lifting units, each having two operating positions and supported on a separate drive shaft, to the respective ends of the differential lever, whereby the lever can be moved into three different positions. The inventive knee joint or cam mechanism which is built into the lifting linkage is constructed so that, during the moment in which the differential lever is in its center position, the heddle frame is in a certain shed position, for example the upper or the lower shed position and, during movement of the differential lever to one of its two outer positions, the heddle frame moves to the other shed position, for example the lower or the upper shed position. With each change in the position of the differential lever triggered by the operating movement of a lifting unit, the heddle frame is moved only between its two end positions, namely, the upper and lower shed positions. Each lifting unit is driven by a respective drive shaft, wherein during rotation of one shaft the other shaft stands still. In other words, while one lifting unit carries out an operating lift, the other lifting unit stands still and can be controlled or actuated during the longer lasting time.

Rotation lifting units are used, and the two drive shafts of the lifting units rotate 180° alternately during the entire or partial rotation of the main shaft of the weaving machine. To carry out the actuation of the lifting unit, the lifting unit and the drive shaft stand still at least during one full rotation of the main shaft of the weaving machine. This long-lasting control period can be shortened to the usual duration through a significant increase in the speed of the dobby. Expressed differently, machine speeds of at least three times the speed of the usual machine can be achieved without reducing control times below a value which, according to current opinion, is considered secure and reliable for dobbies.

The already mentioned rotation dobbies or Hattersley mechanisms, as they are described in combination in the mentioned Swiss Patent No. 501 074 or German Patent No. 1 106 704, the disclosures of which are incorporated herein by reference, can serve as the drive.

BRIEF DESCRIPTION OF THE DRAWINGS

Exemplary embodiments of the invention are illustrated in the drawings, in which.

DETAILED DESCRIPTION

Figure 1:
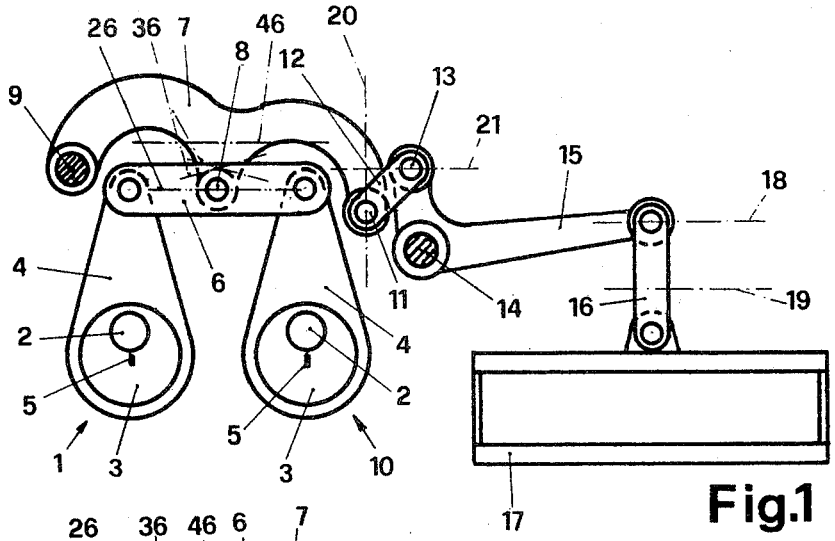
FIG. 1 illustrates a dobby embodying the invention with the heddle frame in the upper shed position.

The dobby of FIG. 1 has two conventional lifting units 1 and 10 which are of the rotation dobby type, for example that according to Swiss Patent No. 517 192, the disclosure of which is incorporated herein by reference. These units are substantially identical and each includes a rotatable drive shaft 2 on which an eccentric disk 3 is supported rotatably. The disk 3 is, in turn, supported rotatably in a circular opening in a connecting rod 4 and has a key 5 which is radially movable with respect to the drive shaft 2 and eccentric disk 3 and is selectively moved radially back and forth by a control mechanism which is not illustrated, for example according to Swiss Patent No. 517 192, so that the disk 3 is coupled either with the drive shaft 2 or with the connecting rod 4. During each such coupling of a disk 3 and a drive shaft 2, the associated lifting unit 1 or 10 carries out an operating movement, namely, the differential lever 6 is pivoted by linear movement of the connecting rod 4 of the actuated lifting unit. Each end of a balance-beamlike differential lever 6 is pivotally engaged by a respective one of the lifting unit 1 and 10. A rocking lever 7 is pivotally supported on a pin 8 located approximately in the center of the differential lever 6. The rocking lever 7 is pivotally supported at one end on an axle 9 which is stationary with respect to the shafts 2. A linking element or plate 12 is rotatably supported by a pin 11 at the free end of the rocking lever 6, and is pivotally connected by a pin 13 to the angle member or lever 15, which is pivotally supported on a further stationary axle 14 and, through the intermediate member 16, acts onto the heddle frame 17 of the weaving machine to effect a controlled up and down movement thereof. The dash-dotted line 18 identifies vertical position of the outer end of the arm of the lever 15 in the upper shed position and the dash-dotted line 19 identifies the vertical position of such arm in the lower shed position.

Figure 2:
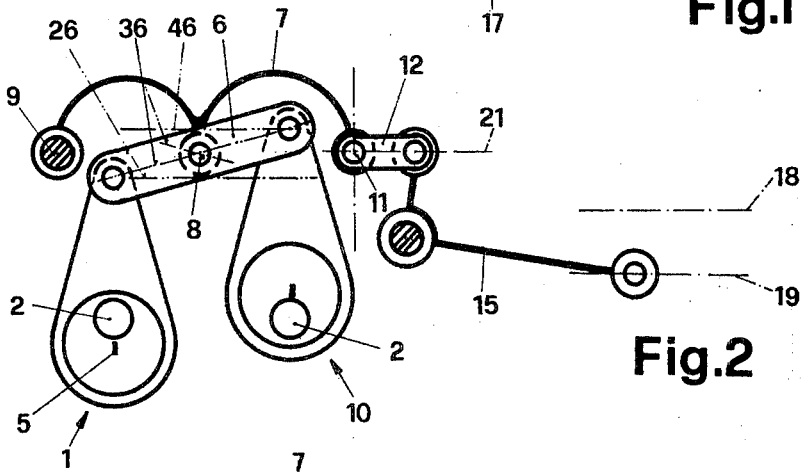
FIG. 2 diagrammatically illustrates the dobby of FIG. 1 with the heddle frame in the lower shed position.
Figure 3:
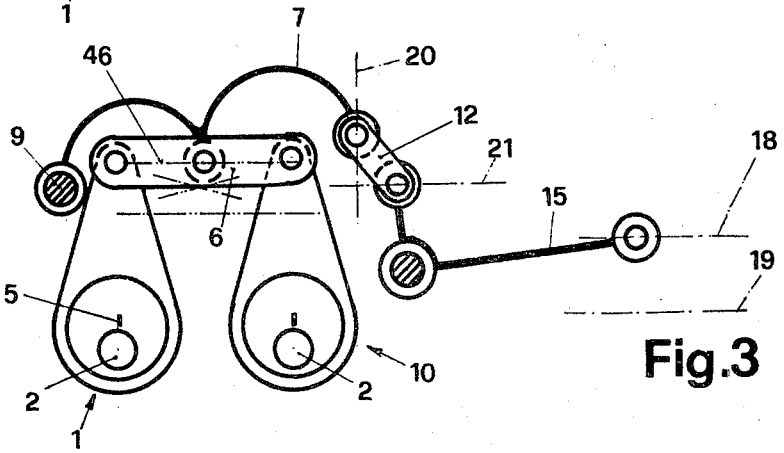
FIG. 3 diagrammatically illustrates the dobby of FIG. 1 with the heddle frame in the upper shed position, wherein a differential lever is in its highest position.

FIGS. 1 to 3 respectively illustrate three possible operating positions of the dobby which are characterized by the vertical positions 26, 36 and 46 of the pin 8 on the differential lever 6, wherein the drive shafts 2 of the two lifting units 1 and 10 are rotated alternately through 180°.

According to FIG. 1, the connecting rods 4 of the two lifting units 1 and 10 are both in a low position, which corresponds to the lower shed position. The differential lever 6 is also in its lower position 26 in which it is positioned parallel to a plane containing the drive shafts 2. The plate 12 is inclined, the pin 11 being lower than the pin 13. The heddle frame 17 is in the upper shed position 18.

By activating the key 5 one of the lifting units 1 and 10, for example the lifting unit 10, the lifting unit 10 carries out work in the sense of lifting its associated end of the differential lever 6 so that such lever, as illustrated in FIG. 2, assumes an inclined position 36. The pin 9 for the differential lever is raised into the intermediate position between the two extreme horizontal positions. With this, the rocking lever 7 and also the pin 11 for the plate 12 are lifted until the plate 12 lies approximately horizontal. This effects a swivelling of the toggle lever 15, causing the heddle frame to move to the lower shed position (FIG. 2). During the lifting movement of the lifting unit 10, the key 5 of the second lifting unit 1 can be actuated.

If, on the other hand, the heddle frame, according to the pattern card, is supposed to remain in the lower shed position, the key 5 of the lifting unit 1 is not actuated to cause its engagement with the drive shaft 2, and during the subsequent rotation of the drive shaft 2 of the lifting unit 1 same no operating movement occurs. The dobby remains in the position illustrated in FIG. 2.

If, however, the heddle frame is to be moved, according to the pattern card, into the upper shed position, the key 5 of the lifting unit 1 is actuated or controlled so as to effect engagement of the associated drive shaft 2 and disk 3. During the rotation of such shaft, the lifting unit 1 moves the left end of the differential lever 6 into its upper position, as shown in FIG. 3. The differential lever 6 now lies parallel again with respect to the plane of the drive shafts 2 but at a higher level. Through this, the rocking lever 7 is swung higher, so that the pin 8 is in the position 46, according to FIG. 3. Also, the left end of the plate 12 is swung upwardly, which causes a swinging of the angle lever 15 from the position according to FIG. 2 into the position according to FIG. 3, which is identical to its position in FIG. 1. The heddle frame 17 thus is moved again to the upper shed position 18. The angle lever 15 thus assumes, in spite of the three control positions of the differential lever 6, only two positions. In order for the foregoing movements to indeed take place, the pin 11 of the plate 12 must carry out a movement 20, in this case an up and down movement, in a direction approximately perpendicular to the direction of movement 21 of the other pin 13 of the plate 12, which in this case moves horizontally.

Figure 4:
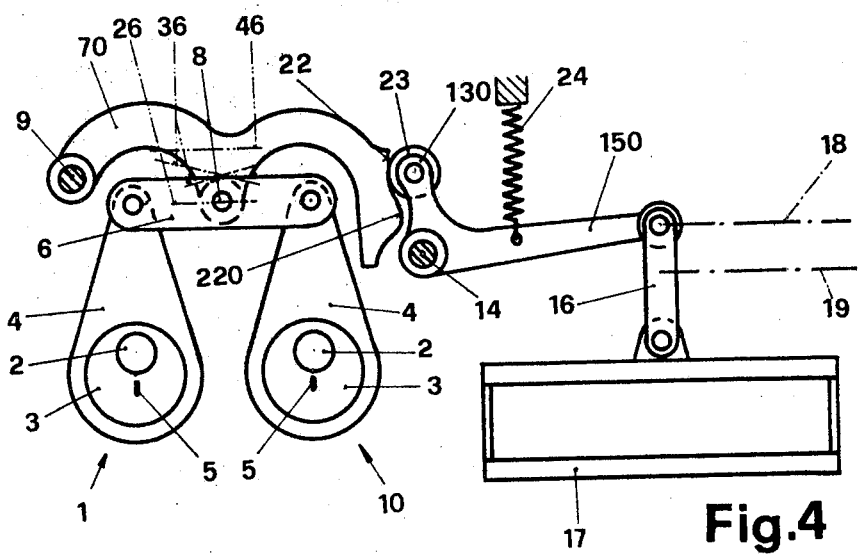
FIG. 4 illustrates an alternative embodiment of the dobby of FIG. 1 which has a lifting linkage with a cam, the heddle frame being in the upper shed position.

The dobby according to FIG. 4 also has two lifting units 1 and 10, the drive shafts 2 of which similarly rotate alternately through 180° steps. The differential lever 6 is pivotally connected at each end to a respective connecting rod 4. The rocking lever 70 pivotally engages, as in FIGS. 1 to 3, a pin 8 on the differential lever 6. The lever 70 has, at its free end, a cam surface 22 which has, approximately in its center, a cam 220. The free end 130 of the angle lever 150 rests, under the urging of a spring 24, against the cam surface 22.

The lifting units 1 and 10 in FIG. 4 both have their connecting rods 4 in the low position. The free end 130 of the lever 150 is provided with a roller 23, which rests on the cam curve 22 above the cam 220. The heddle frame 17 is thereby lifted into the upper shed position 18 by the lifting linkage 150 and 16. If the heddle frame 17 is now to be moved to the lower shed position, the key 5 of the one of the two lifting units 1 and 10, for example the lifting unit 10, is actuated to effect engagement of its drive shaft 2 and disk 3. During the rotation of such shaft 2, while the other shaft stands still for its next control, the lifting unit 10 lifts the connecting rod 4, by means of the eccentric disk 3, into its upper position. The lifting units 1 and 10 and the differential lever 6 of FIG. 4 thus assume positions similar to the corresponding parts in FIG. 2. The cam surface 22 slides upwardly until the roller 23 rests on the cam 220 and the angle lever 150 thereby is pivoted, against the force of the tension spring 24, about the axle 14. Through this, the heddle frame 17 is moved to its lower shed position 19.

Further operation of the dobby, which depends on the movement of the lifting units, corresponds generally with the positions which have been described in connection with FIGS. 1–3. When the differential lever 6 is in the upper position, similar to that in FIG. 3, then the roller 23 rests on the lower part of the cam surface 22, namely, below the cam 220. The heddle frame 17 is thus again moved into the upper shed position.

Figure 5:
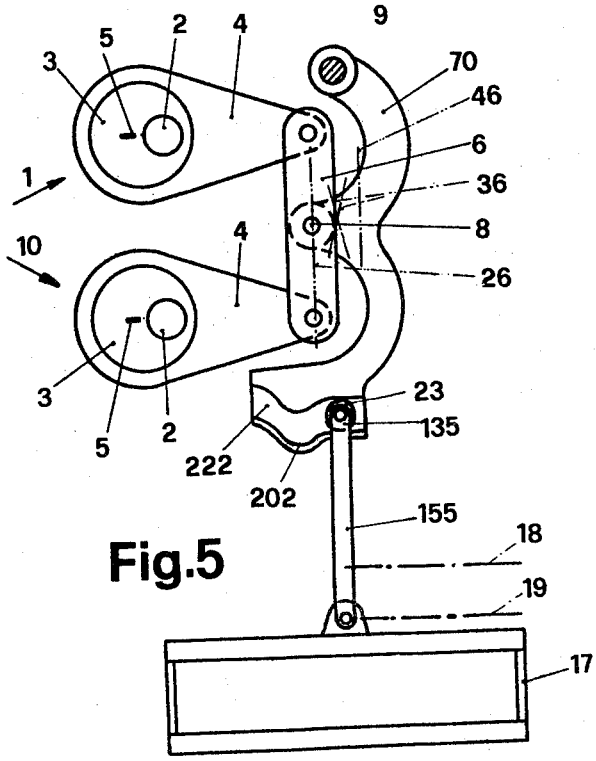
FIG. 5 illustrates a modification of the embodiment according to FIG. 4.

The alternative embodiment which is illustrated in FIG. 5 corresponds generally in structure with the embodiment according to FIG. 4, except that the open cam surface 22 of FIG. 4 is replaced with dual facing cam surfaces 202 (FIG. 5) which are constructed as a groove 222. A roller 23 on the free upper end 135 of a linearly movable member 155 is disposed in the groove 222. The member 155 is directly connected to the heddle frame 17. A spring on the member 155 is not needed, since the member 155 is automatically guided for movement in both directions by the opposite sides of the groove 222.

If the weaving machine operates without shed standstill, then there is available for the patternlike control of each key 5, as already mentioned, at least the duration of one pick or a full rotation of the main shaft of the weaving machine, since the two lifting units always operate alternately and independently to effect the next-requested heddle frame position, unless a position change in the heddle frame does not take place.

The difference between a conventional dobby, which for example has a shed standstill of $T=60°$ and a duration of $Z=180°$ for one pick, and the exemplarily described inventive machine is that the actuation of the dobby in the former must occur during $T=60°$ and in the latter during $Z+T=240°$. The new machine can thus operate with conventional control times but at $240 \div 60=4$ times the machine speed.

As can be recognized from the drawing and the description, the center pin 8 of the differential lever 6 assumes three operational positions 26, 36 and 46. When the pin 8 is in the center position 36, the heddle frame 17 is moved into one shed position, for example the lower shed position 19, and when the pin 8 is in either of the two extreme or outside-lying operating positions 26 or 46, the heddle frame 17 is moved into the other shed position, for example the upper shed position 18. Of course, this control can also be done in a reverse manner. This different control with respect to upper and lower shed represents one of the important differences of the present dobby compared with the known and so-called three-position dobbies.

Aside from the aforementioned discussions with respect to the actual design of the dobby, it is pointed out that the invention relates primarily to the novel lifting linkage.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a high-speed dobby having a balance-beamlike differential lever, at approximately the center of which is pivotally supported a rocking lever for movement about a first axis, the rocking lever being pivotally supported at one end for movement about a stationary second axis spaced from the first axis and being part of lifting linkage means adapted for moving a heddle frame of a weaving machine between two positions in response to movement of the differential lever, a center pivot point on the differential lever being coincident with the first axis and able to assume three operating positions, and including respective lifting units which are each controlled for movement between two positions and are each operatively coupled to a respective end of the differential lever, the improvement comprising wherein said lifting linkage means includes linking means which is one of a knee joint mechanism and a cam mechanism and which moves the heddle frame, for each outer operating position of the center pivot point of the differential lever, into a first position and, for the center operating position of the center pivot point of the differential lever, into a second position.

2. The dobby with a lifting linkage according to claim 1, wherein the lifting linkage means includes a member supported for movement between two positions and operatively coupled to the heddle frame, movement of the member between its two positions effecting movement of the heddle frame between its first and second positions; wherein the knee joint mechanism is provided as the linking means; and wherein the knee joint mechanism includes a linking element which has one end pivotally supported at one pivot point on a free end of the rocking lever remote from said one end thereof and which has its other end pivotally supported at a second pivot point on the member of the lifting linkage means.

3. The dobby with a lifting linkage according to claim 2, wherein the linking element of the knee joint mechanism is oriented so that the path of movement of said one pivot point thereof extends approximately perpendicular to the path of movement of said second pivot point thereof.

4. The dobby with a lifting linkage according to claim 1, wherein the lifting linkage means includes a member supported for movement between two positions and operatively coupled to the heddle frame, movement of the member between its two positions effecting movement of the heddle frame between its first and second positions; wherein the cam mechanism is provided as the linking means; wherein the cam mechanism includes, at a free end of the rocking lever remote from said one end thereof, a cam surface which has an approximately centrally arranged cam; and wherein the member of the lifting linkage means has a cam follower thereon which operatively engages the cam surface to effect movement of the member in response to pivotal movement of the rocking lever.

5. The dobby with a lifting linkage according to claim 4, wherein the cam mechanism includes a spring which is coupled to and yieldably urges movement of the member in a direction corresponding to movement of the cam follower into engagement with the cam surface.

6. The dobby with a lifting linkage according to claim 4, wherein the cam surface includes a surface in a groove provided in the rocking lever, the cam follower being slidingly supported in the groove.

7. The dobby with a lifting linkage according to claim 4, wherein the cam surface extends approximately concentrically with respect to said second axis.

8. The dobby with a lifting linkage according to claim 5 or claim 6, wherein the cam follower includes a roller which is provided on the member and engages the cam surface.

9. The dobby with a lifting linkage according to claim 2 or claim 4, wherein the member is a lever having two arms arranged at an angle to each other and is pivotally supported on a stationary axle in the region of the intersection of its arms.

10. The dobby with a lifting linkage according to claim 1, wherein the two lifting units are parts of a rotation dobby.

11. The dobby with a lifting linkage according to claim 10, wherein the two lifting units are each driven by a respective driveshaft; and wherein during rotation of each said driveshaft, the other driveshaft stands still.

12. The dobby with a lifting linkage according to claim 11, wherein the control of each lifting unit can be effected during the entire duration of the standstill of the associated driveshaft.

13. The dobby with a lifting linkage according to claim 2 or claim 4, wherein the member is supported for substantially linear movement between said two positions thereof.

* * * * *